United States Patent [19]

Stilwell

[11] 4,217,065

[45] Aug. 12, 1980

[54] SLIP-FORM CURB AND GUTTER MACHINE

[76] Inventor: Leo J. Stilwell, Rte. 4, Peavine St., Dowagiac, Mich. 49047

[21] Appl. No.: 911,800

[22] Filed: Jun. 2, 1978

[51] Int. Cl.[2] ..... E01C 11/28

[52] U.S. Cl. ..... 404/98

[58] Field of Search ..... 404/98, 96, 108, 110, 404/105; 425/63, 456

[56] References Cited

U.S. PATENT DOCUMENTS

| | | | |
|---|---|---|---|
| 2,225,015 | 12/1940 | Lebelle | 404/98 X |
| 2,541,547 | 2/1951 | Robinson | 404/96 |
| 2,623,446 | 12/1952 | Clark | 404/98 |
| 2,707,422 | 5/1955 | Canfield | 404/98 |
| 2,847,916 | 8/1958 | Andrus | 404/98 |
| 2,950,660 | 8/1960 | Standfuss | 404/108 |
| 3,108,518 | 10/1963 | O'Connor | 404/96 X |
| 3,161,117 | 12/1964 | Supject | 404/98 |
| 3,164,072 | 1/1965 | Blankenship | 404/96 |
| 3,261,272 | 7/1966 | Jennings | 404/98 |
| 3,435,740 | 4/1969 | McGall | 404/96 |
| 3,605,581 | 9/1971 | Heaton | 404/98 |
| 3,779,662 | 12/1973 | Smith | 404/98 |
| 4,027,990 | 6/1977 | Merrill | 404/98 |

*Primary Examiner*—Nile C. Byers, Jr.

*Attorney, Agent, or Firm*—Blanchard, Flynn, Thiel, Boutell & Tanis

[57] ABSTRACT

A slip-form machine for concrete curb and gutter includes a chassis having wheels adjustably mounted for guiding the machine along fixed straight or curved tracks. A concrete receiving hopper carriers a vibrator support unit adjustable linearly and pivotally about several axes. Interchangeable forms each attach to the chassis behind the hopper to receive concrete therefrom and have sidewalls extending downward below the wheels and substantially to the ground. A hand winch fixed above the hopper has cable guided out the forward lower hopper portion for advancing the machine and is energized by an operator standing on a chassis mounted platform above the form. A trowel is vertically adjustably fixed to the rear of the form and is separated from it by a substantially constant bubble escape gap. A reinforcing guide rod unit is releasably fixable to the lower front wall of the hopper.

15 Claims, 10 Drawing Figures

SLIP-FORM CURB AND GUTTER MACHINE

FIELD OF THE INVENTION

This invention relates to a curb and gutter forming machine, and more particularly to a machine for slip-forming a concrete curb or curb and gutter.

BACKGROUND OF THE INVENTION

Machines for slip-forming concrete curbing or curb and gutter in situ have long been known. Typically, such machines are moved forward along the path of pour and have a hopper for receiving wet concrete from a mixer. Such concrete drops through the hopper onto the ground and a form communicating with the rear of the hopper slides over and shapes the concrete, the intention being to leave a properly shaped integral curb-gutter of indeterminate length formed in place therebehind. However, prior slip-form machines of which I am aware have not been entirely satisfactory, for a number of reasons.

For example, in one type of prior slip-form curb and gutter machine, a tractor equipped with hydraulic lifts is required to suspend and advance the hopper and slip-form unit along the proposed path of the curb-gutter. Because of the very high cost of a conventional tractor equipped with hydraulic lifts, such machine is not suitable for many curb and gutter jobs, particularly smaller ones, and cannot compete with other more economically constructed machines. Also, the direction of the path along which the curb-gutter is laid depends on steering of the tractor and can be thrown off by momentary inattention of the driver, looseness or "play" in the tractor steering, or a previously unnoticed bump in the path of a tractor wheel. Also, since he must not only control speed, but must also steer the tractor, the operator is both poorly positioned to view, and has relatively little time to supervise, actual curb forming, including flow of concrete to the hopper, quality of the curb emerging from the slip-form, etc. Moreover, whereas it normally may be desired to suspend the hopper-slip-form unit centrally beneath the tractor, formation of a curb-gutter close-by obstructions, e.g. trees, would be prevented by the fact that a conventional tractor is much wider than a conventional curb-gutter ribbon. However, to suspend the form and hopper beside the tractor adds further cost and complication to the hydraulic lift and mounting apparatus, further distorts the operator's view of the slip-forming operation, and results in a total vehicle width which may approach or exceed local or state limits for road travel from job to job.

The second basic type of prior machine does not use a tractor but rather comprises a hopper and slip-form unit supported and guided for advancement atop a pair of fixed guides laid in spaced parallel relation on the ground along the path of curb-gutter pour. Typically, such guides are upstanding plates and serve as fixed forms for the opposite sides of the curb-gutter ribbon, while the advancing hopper and slip-form unit is shallow and merely shapes the top of the concrete curb-gutter ribbon. However, to be practical, the fixed side forms must be much longer than the hopper and slip-form unit and must be accurately sized as to height. Also, two pair of such forms are required to permit the hopper and slip-form unit to advance from one pair to the next for continuously forming a long, in situ curb-gutter ribbon. Thus, such fixed side forms add substantially to the cost of the curb-gutter machine. Also, it is difficult and time consuming to set up such side forms since they determine the vertical angle of the finished curb gutter sides, must be a constant separation spacing, and must have their top edges at a constant preselected offset in height from each other.

Machines of this second type typically have been advanced by pulling by the concrete truck or have carried a relatively costly motor or engine for pulling the slip-form-hopper unit along guides. The former may result in yawing or jerky forward movement and divorces control of forward movement from the operator located at the slip-form unit. The latter, aside from the extra cost of the motor or engine and its transmission, tends to make the machine too heavy to be readily lifted by a typical two man curb-gutter forming crew, tends to induce unwanted misplaced vibration, and/or requires additional power supplies or electric cords on or to the slip-form and hopper unit.

Typical prior art machines of the general type above referenced may be seen for example in U.S. Pat. Nos. 3,954,359, 4,027,990, 3,208,362, 3,108,518 and 3,733,141.

Accordingly, the objects and purposes of this invention include the provision of:

1. A machine for slip-forming a concrete curb and gutter ribbon, on the site and without limitation as to continuous curb-gutter ribbon length.

2. A machine, as aforesaid, of relatively light weight and compact size, which can be transported from job to job on a conventional pick-up truck and can readily be lifted by two men onto and off of such a truck.

3. A machine, as aforesaid, including an operator support platform atop the slip-form portion of the machine, by which the weight of the machine operator assists in compacting and forming the concrete curb-gutter ribbon, while providing the operator a vantage point for close and direct observation of the entire slip-forming operation from feeding of concrete to the hopper through the action of the trailing edge of the machine in final smoothing and troweling of the concrete ribbon, and from which the operator can directly control positioning and operation of concrete flow inducing vibrator devices and can precisely control forward advance of the machine through hand winching.

4. A machine, as aforesaid, in which height and direction of machine travel is controlled simply yet precisely by support of machine wheels on two side-by-side tracks, one of which is provided with a longitudinal guide member, wherein the tracks are normally on the same level and tractor guides may be simply formed of common construction materials, and wherein machine supporting wheels are adjustable for forming small radius curved sections of curb-gutter ribbon.

5. A machine, as aforesaid, which is free of fixed side forms and in which support and guidance of the machine is independent from forming of the curb-gutter ribbon, wherein the slip-form has side walls extending downward preferably past the top of the track and which are the sole forming surfaces for the sides of the curb-gutter ribbon.

6. A machine, as aforesaid, which provides a fixed width gap for escape of air bubbles from the concrete surface just ahead of the final troweling portion of the machine and provides for vertical adjustment, as a unit, of such final trowel portion, and in which the machine may support and guide reinforcing rods into the concrete mass being poured, to produce a steel reinforced concrete ribbon.

7. A machine, as aforesaid, capable of interchangeably supporting different cross-section slip-forms and trowel units for forming curbs, gutters, or combination curb-gutter ribbons of any desired cross-sectional shape, and in which the machine can be converted from one cross-sectional configuration to another rapidly and easily, with only ordinary hand tools and without special skill.

8. A machine, as aforesaid, constructable at low cost of normally available materials without need for elaborate production machinery and capable of economically handling a wide variety of large or small slip-forming jobs, and which is capable of relatively rapid set-up and operation by only two men (e.g. an operator and a concrete chute attendant).

Other objects and purposes of this invention will be apparent to persons acquainted with apparatus of this general type upon reading the following specification and inspection of the accompanying drawings.

SUMMARY OF THE INVENTION

The objects and purposes of the invention are met by providing a slip-form machine for concrete curb and gutter which includes a chassis having wheels adjustably mounted for guiding the machine along fixed straight or curved tracks. A concrete receiving hopper carries a vibrator support unit adjustable linearly and pivotally about several axes. Interchangeable forms each attach to the chassis behind the hopper to receive concrete therefrom and have sidewalls extending downward below the wheels and substantially to the ground. A hand winch fixed above the hopper has cable guided out the forward lower hopper portion for advancing the machine and is energized by an operator standing on a chassis mounted platform above the form. A trowel is vertically adjustably fixed to the rear of the form and separated from it by a substantially constant bubble escape gap. A reinforcing guide rod unit is releasably fixable to the lower front wall of the hopper.

DETAILED DESCRIPTION

Figure 1:
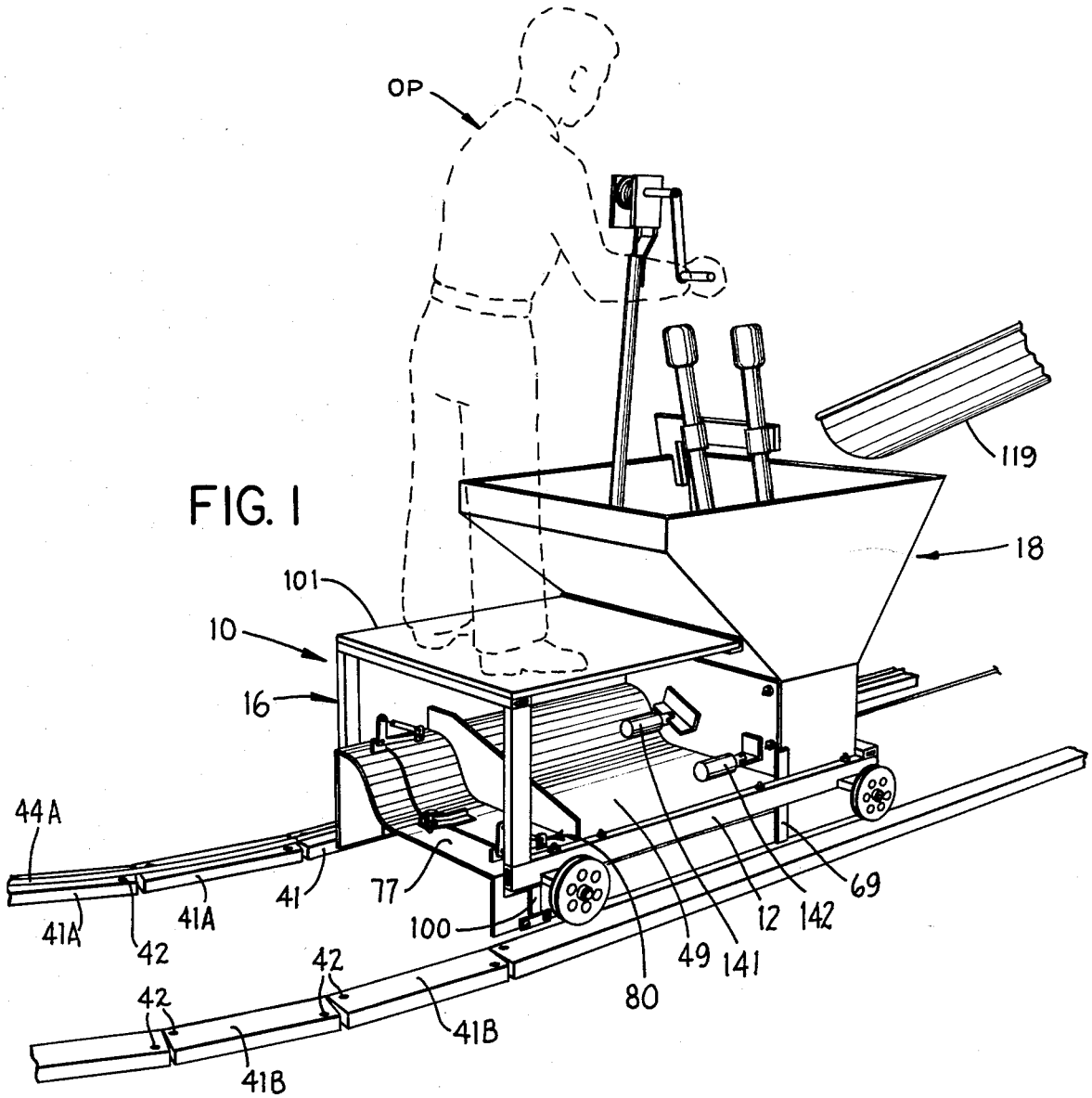
FIG. 1 is a pictorial view taken from the right rear quarter of a slip-form machine embodying the invention.
Figure 3:
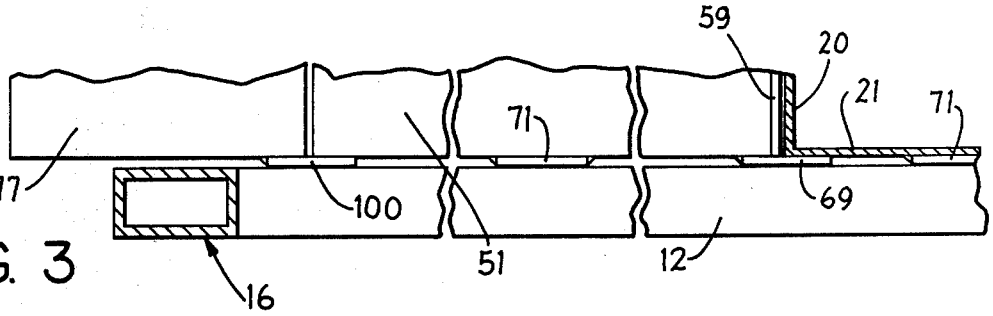
FIG. 3 is an enlarged, fragmentary sectional view substantially as taken on the line III—III of FIG. 2.
Figure 2:
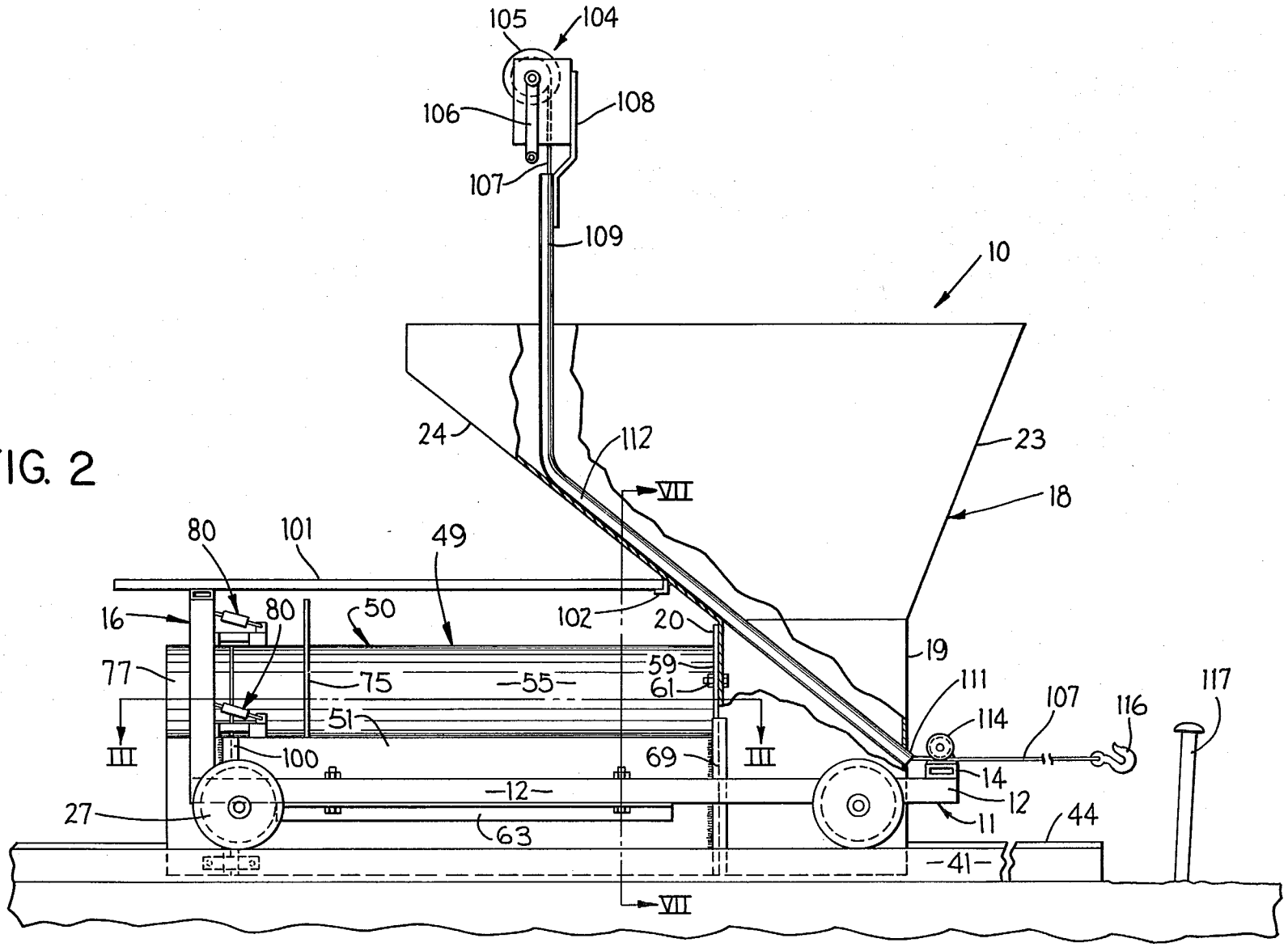
FIG. 2 is a partially broken, fragmentary, enlarged right side elevational view of the machine of FIG. 1.
Figure 4:
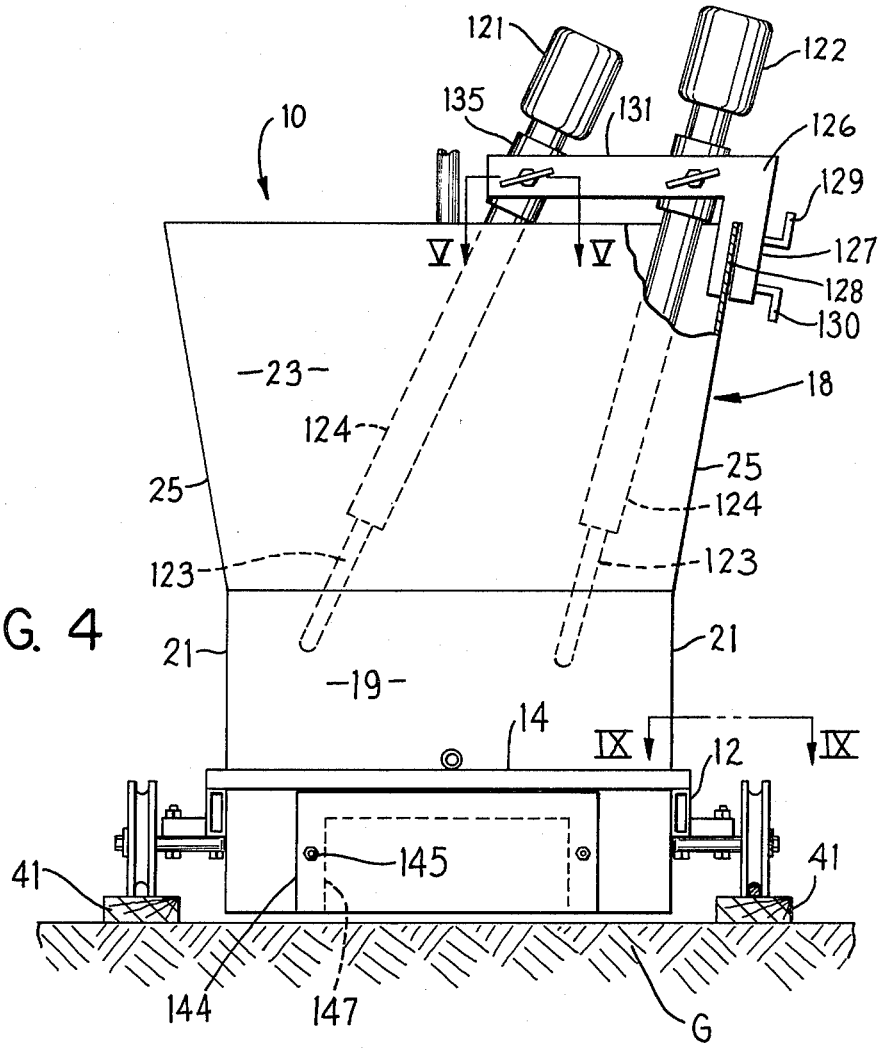
FIG. 4 is an enlarged front elevational view of the machine of FIG. 1.
Figure 5:
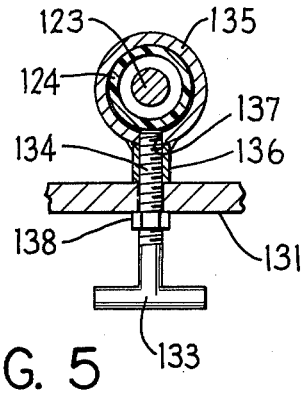
FIG. 5 is an enlarged fragmentary sectional view substantially taken on the line V—V of FIG. 4 showing a portion of the adjustable hopper-vibrator mounting.

FIGS. 1, 2 and 4 disclose a preferred embodiment of the invention in which a slip-forming machine 10 comprises a laterally spaced pair of horizontal side rails 12, joined at their front and rear ends, respectively, by a front cross member 14 (FIG. 2) and an upstanding, U-shaped platform rear support 16, rigidly fixed to each other as by welding and forming a rigid frame 11, of substantially rectangular plan. The frame is preferably of aluminum tubing.

A hopper 18 (FIGS. 1, 2 and 4) includes a lower portion, substantially rectangular in plan, defined by front, side and rear walls 19, 20 and 21 rigidly joined, as by welding. The lower hopper portion extends up past side rails 12 and is rigidly supported thereon, as by welded connection between the side walls 21 and corresponding side rails 12, as hereinafter described. The upper portion of hopper 18 comprises further front, rear and side walls 23, 24 and 25 which diverge upwardly from and are fixed to lower side walls 19, 20 and 21, respectively. Hopper 18 is funnel-like, and open at its upper and lower ends.

Figure 10:
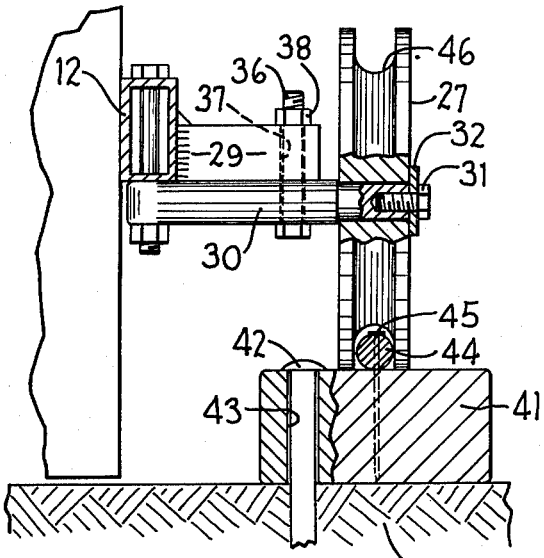
FIG. 10 is a front elevational view of the FIG. 9 wheel mounting.
Figure 9:
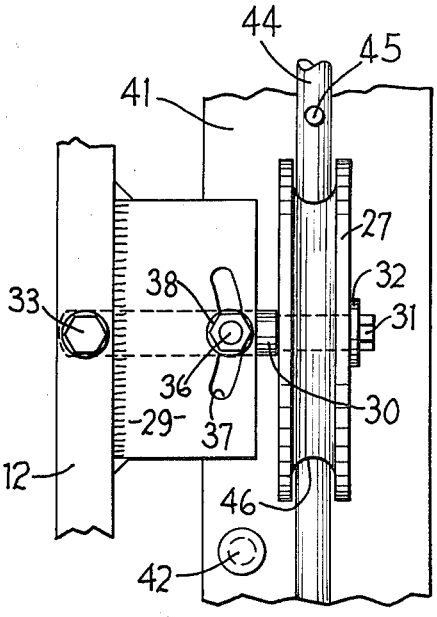
FIG. 9 is an enlarged fragmentary sectional view substantially taken on the line IX—IX of FIG. 4 and showing a top view of the steering angle adjustor for mounting a wheel.

Wheels 27 (FIGS. 2, 4, 9 and 10) support frame 11 substantially at the four corners thereof and lie outward of the side rails 12. In the preferred embodiment shown, all four wheels are pivotally adjustable with respect to the frame for forming of even relatively sharp radiused curves in a curb-gutter ribbon. To this end, a block 29 (FIGS. 9 and 10) is fixed (as by welding) in cantilevered relation outboard from the side rail 12 at the location of each wheel 27. Each wheel 27 is rotatable on an axle 30, being retained thereon as by a cap screw 31 and washer 32. Axle 30 extends laterally beneath block 29 and has a rounded inner end portion pivotally secured beneath side rail 12 by a vertical through-bolt 33 and nut 34, or the like. To lock the axle 30 at a desired angle to the side rail, a stud 36 fixed to axle 30 extends upward therefrom through a semicircular slot 37 in block 29 and carries a nut 38 tightenable to lock axle 30 with respect to block 29.

To guide the machine along the desired path of the curb-gutter ribbon, the preferred embodiment of the invention employs a simplified track construction. Thus, an elongate track member 41, conveniently a wooden two-by-four, is provided on each side of the proposed curb-gutter path, substantially at the same lateral spacing as the wheels 27 for substantially centered support of the latter. Track members 41 lie atop the ground G (FIG. 10), the track members 41 on opposite sides of the machine preferably being at the same level, or height. Elongate stakes 42 extend down through holes 43 in track members 41 to fix the latter to the ground G. One of the track members 41 fixedly supports, as a lateral guide for the wheels, a conventional half-inch reinforcing rod 44, periodically secured thereby by nails or screws 45. The wheels 27 on that side of the machine are circumferentially grooved at 46 to loosely receive the rod 44 and guide the machine along tracks 41. The wheels 27 on the other side of the machine are, to ride through rather than over obstructions, also grooved, but preferably are not guided laterally and instead simply ride atop the flat upper surface of the corresponding track member 41.

This relatively simple track and wheel arrangement readily adapts to slip-forming a horizontally curved curb-gutter ribbon. As generally indicated in FIG. 1, for example, the curved portion of the machine path can be defined by short track member sections (e.g. a foot or two in length) 41A and 41B individually staked at 42 to the ground to form the desired curve. A further section 44A of reinforcing rod suitably provided with nail holes and bent to the desired curvature is nailed or screwed to the corresponding track member blocks 41A arranged along the desired curved machine path. The curved rod 44A may be curved on the site or may be selected from one of a number of standard precurved rods 44A. Since the track members are staked to the ground, it is not necessary to end join abutting track member ends or rod ends. Since the curvature of the resulting curb-gutter ribbon is established by rod 44A, track member blocks 41B for the other side of the machine need be positioned only with sufficient accuracy as to prevent the wheels on that side of the machine from falling off onto the ground. Since track members 41 are not in contact with and do not form the sides of the concrete ribbon, variations, of for example an inch or so, in the lateral spacing between the two tracks make no difference in the resulting curb-gutter ribbon and, accordingly the tracking 41 for the inventive machine can be laid rapidly by relatively unskilled persons.

Figure 7:
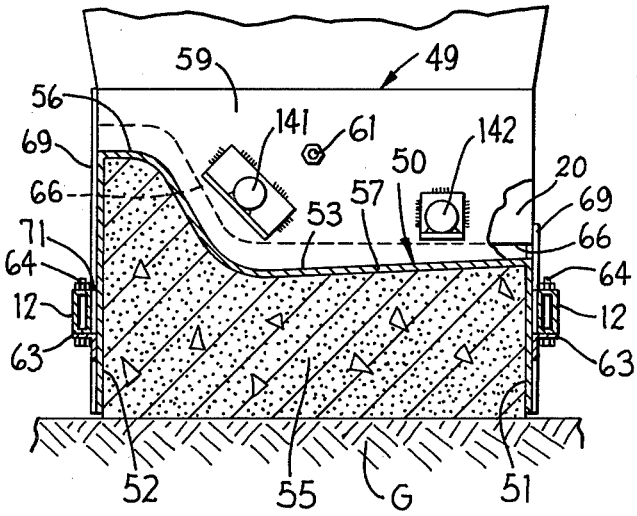
FIG. 7 is a sectional view substantially taken on the line VII—VII of FIG. 2.

A slip-form 49 (FIGS. 1, 2 and 7) is removably supported by side rails 12 immediately behind the lower portion 19–21 of hopper 18. Form 49 comprises a metal sheet 50 extending with a substantially uniform cross section from about the location of rear wheels 27 to hopper 18. Slip-form sheet 50, as seen in cross section from the rear in FIG. 7, has laterally spaced, generally upstanding side walls 51 and 52, the upper edges of which are joined by a preferably integral top wall 53. The bottom edges of side walls 51 and 52 are normally close spaced above the ground G and therewith and with top wall 53 define a fore-aft extending concrete slip-forming chamber 55 open at its front and rear ends. Side walls 51 and 52 thus shape the corresponding sides of the concrete curb-gutter ribbon being laid, whereas the top wall 53 determines the form of the upper surface of such curb-gutter ribbon. It will be understood that walls 51–53 of form 50 may be provided in any desired shape or size consistent with the desired cross-sectional configuration of the curb-gutter (or merely curb or gutter) ribbon to be formed, the particularly cross-sectional shape shown in FIG. 7 being merely one of a number of possible configurations, which happens to have a top wall 53 including a high curb defining portion 56 and a low gutter defining portion 57.

To add stiffness and assist in mounting, slip-form 49 further includes an upstanding front plate 59 welded atop the front edge portion of top wall 53, and adapted to surface abut the rear wall 20 of the lower portion of hopper 18 to which it is preferably releasably secured by a nut and bolt unit 61.

The remaining slip-form support takes the form of members, here angle cross section members 63, fixed as by screws or welding to the outer faces of respective slip-form side walls 51 and 52. The outthrust flanges of such angle members 63 snugly underlie and are bolted, at 64, to the undersides of respective frame side members 12, to complete support of the slip-form on the machine. To provide for compaction and smoothing of concrete traveling through the slip-form, the latter angles downward toward the rear somewhat, for example ¼ inch in 30 inches of length. To this end, angle members 63 are not parallel to the lower edges of form side wall 51 and 52 or to top wall 53. Instead, the front ends of angle members 63 ride somewhat lower on the form side walls than do their rear ends. By releasing bolts 61 and 64, a given slip-form 49 can be released from the frame and hopper (normally the remainder of the machine is lifted up, or moved forward, from the slip-form). In the opposite manner, a new and differently contoured slip-form may be installed on the frame side members and hopper of the machine.

The rear wall 20 of the lower hopper portion has its lower part cut away, leaving a downwardly facing edge 66 below bolt 61, but above the highest desired top wall 53 of any alternate form 49 desired to be used with the machine. The removal of hopper rear wall 20 below edge 66 thus places the concrete chamber 55 of the slip-form in full communication with the rear lower portion of the hopper for receiving concrete therefrom as the machine advances.

To prevent any tendency for leakage of concrete, upstanding battens 69 are fixed as by welding outside the rear edge portions of hopper side walls 21. The battens 69 extend rearward to overlap the side walls 51 and 52 of the slip-form. Spacers 71, of thickness similar to battens 69, are welded to the outer faces of the form sides to space such form side walls therebetween. Further spacers 71 sandwiched between side rails 12 and the hopper are welded to both to establish the welded connection between the hopper and side rails.

In the preferred embodiment shown, an upstanding sheet metal baffle 75 fixed (preferably welded) to the slip-form top wall 53 near its rear edge, stiffens the form and tends to act as a vibration barrier, such that vibration in the forward portion of the form sheet 50 ahead of baffle 75 is substantially diminished or eliminated behind baffle 75, contributing to a smoother surface finish on the concrete ribbon extruding from the machine.

Figure 8:
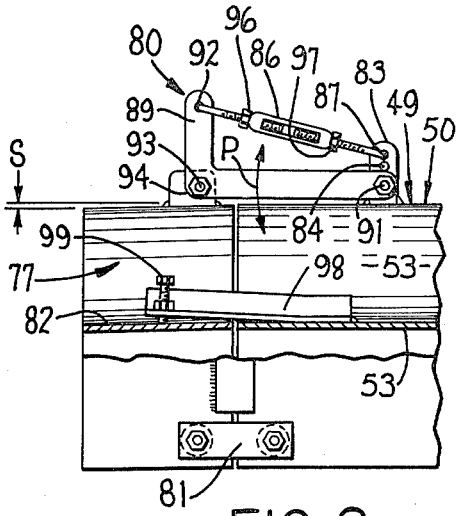
FIG. 8 is an enlarged and partially broken fragment of the leftward end of the FIG. 2 machine.

To further surface and smooth such emerging ribbon, a sheet metal trowel member 77 (FIGS. 2 and 8) preferably of cross sectional configuration identical to that of slip form 49, is vertically adjustably supported adjacent the rear edge of slip form sheet 50, substantially as a longitudinal extension thereof. To provide a suitable smoothing or troweling action, the surface of trowel 77 tilts downward toward the rear at a somewhat greater slope than does top wall 53 of form 49, namely with a slope S of about ¼ inch in four inches. This slope is substantially constant and trowel member 77 does not pivot with respect to the rear edge of slip-form 49, but rather it is adjustable up and down with respect thereto to provide greater or lesser compression of the surface of the concrete along which it is moved.

To provide such vertical adjustment, substantially horizontal pivot links 81 pivotally connect the adjacent lower portions of the sides of the slip-form 49 and trowel 77. Suitable adjustable supports 80 are fixed atop slip-form top wall 53, near the opposite side edges thereof, and rearwardly overhang same to pivotally support the corresponding side portions of the top wall 82 of trowel 77. Each adjustable support 80 comprises an upstanding post 83 welded atop slip-form sheet 50 and preferably provided with a plurality of vertically distributed, alternatively selectable mounting holes 84. A turnbuckle 86 has its front end pivotally mounted as by a bolt 87 in a desired one of holes 84 and slopes upward toward the rear. A substantially L-shaped link 89 has the forward free end of its horizontal leg pivoted as by a further bolt 91 near the bottom of post 83 in such a manner as to permit up-and-down pivoting, as indicated by arrow P. The free end of the upper leg of L-shaped link 89 is pivotally secured to the free end of turnbuckle 86, as by a further bolt 92. The mid, or corner, portion of L-shaped link 89 is pivoted, as by a bolt 93, to an upstanding tab 94 fixed atop trowel 77 as by welding. If desired, lock nuts 96 and 97 may be provided at the ends of the turnbuckle body to lock in any desired length adjustment. Shortening and lengthening of the turnbuckle, respectively, rotates the L-shaped link 89 in clockwise and counterclockwise directions, which by pivoting upward and downward along arrow P, serves to raise or lower, respectively, the trowel 77.

To prevent upward bending of the top center portion of the trowel, a bar 98 is welded to and overhangs rearwardly the center portion of form top wall 53. A screw 99 threaded downward through the rearward end of bar 98 bears down against the central portion of trowel top wall 82, at a point below a line connecting the pivots 93 of the rightwardly and leftwardly disposed adjustable supports 80.

Further battens 100, like battens 69, are welded to the front edge portions of trowel 77 to receive the back edges of the side walls of form 49 therebetween, again to minimize leakage of concrete therepast.

Hopper side walls 21 preferably diverge downwardly slightly (e.g. with the bottom of each side wall offset out about $\frac{3}{8}$ inch), the slip-form and trowel side walls similarly sloping.

A horizontal platform 101, which may simply be a piece of plywood extending the width of the inverted U-shape support 16, is fixed atop the latter, as by screws not shown, and extends forward therefrom to the upper rear wall 24 of hopper 18. Preferably, an angle member 102 is welded to the hopper to support the front edge of platform 101. As indicated in broken lines in FIG. 1, the machine operator OP may thus normally stand atop platform 101 to operate machine 10. The added weight of the operator holds down the slip-form and trowel portions of the machine firmly against the concrete ribbon to properly shape and surface same, and thus permits the machine itself to be light in weight, so it can readily be carried by two men to a job site. Indeed, in the preferred embodiment shown, major parts of the machine, e.g. frame 11, hopper 18, blocks 29, slip-form 49, trowel 77, etc. are preferably of aluminum alloy to minimize weight.

In the preferred embodiment shown, a hand winch 104 is fixedly spaced above the rear portion of hopper 18. Winch 104 is conveniently an inexpensive, commercially available hand crank winch, for example of the type widely used on boat trailers. Winches of this type, upon manual rotation of the handle 106, wind up cable 107 on a drum 105. Winch 104 is supported on a bracket 108 welded atop a rigid pipe 109. Pipe 109 extends fixedly upward from the upper back wall portion 24 of hopper 18 and terminates well above the hopper 18 to place the winch handle 106 at a convenient location for hand cranking by the operator OP standing on platform 101. The lower portion of pipe 109 is angled forwardly along the front surface of back hopper wall 24 and extends diagonally through the lower hopper portion 19–21 and forward snugly through a suitable opening in the central lower portion of front hopper wall 19 at its open lower end 111. Pipe 109 is fixed, as by welding and/or brackets 112, to supporting surfaces 24 and 19 of the hopper 18. In addition to rigidly locating winch 104, pipe 109 leads winch cable 107 downwardly and forwardly out the forward end of the hopper near frame front cross member 14. A pulley 114 conveniently mounted on the central front portion of the machine leads cable 107 forward in non-chaffing relation away from the machine. By terminating the forward end of cable 107 in a suitable fitting, such as a hook 116, the latter may be secured to a stake 117 driven in the ground ahead of the machine 10, such that rotation of winch handle 116 by the operator advances the slip-form machine along tracks 41 and cable 107 toward stake 117 to lay a concrete curb and gutter ribbon.

It will be understood that concrete is supplied to the hopper at its open upper end, as by a conventional trough 119 (FIG. 1) from a concrete truck or the like not shown.

To insure proper flow of relatively thick concrete mix down through the hopper and to completely fill slip-form concrete chamber 55, a pair of conventional electric vibrators 121 and 122 (FIG. 4) having downwardly extending, rodlike vibrating ends 123, are adjustably mounted within the hopper by means of a mounting unit 125. Mounting unit 125 comprises a substantially L-shaped bracket 126 having a downwardly extending leg 127 slotted at 128 to receive the upper edge portion of the hopper side wall 25. Hand screws 129 and 130 may both be loosened to permit fore-aft movement of bracket 126 and vibrators 121, 122 supported thereby along the length of the hopper. By loosening only the lower hand screw 130, bracket 126 can be adjusted in pitch (rocked forward and rearward) about the axis defined by upper screw 129, to change the angle, as seen from the side, of vibrator shanks 123.

The horizontal upper leg 131 of L-shaped bracket 126 extends partway over the open upper end of the hopper. To provide further adjustment, the threaded portions of further hand screws 133 extend slidably through laterally spaced holes 134 extending in a fore-aft direction through bracket leg 131. Axially short, substantially upstanding pipe sections 135 slidably and rotatably house the shank portions 123 of the vibrators. An internally threaded hollow stem 136 extends radially from each pipe section 135 in coaxial relation to a radial opening 137 extending through the side wall of pipe section 135. Stem 136 may be provided by welding a conventional nut to the side of pipe section 135. Thus, the tip end of the hand screw 133, extending through hole 134 threads into and through stem 136 to engage, in the manner of a set screw, an elongate pipe 124 to axially lock (or upon loosening to permit axial adjustment of) the latter with respect to pipe section 125 and bracket leg 131. Pipe 124 supports the enlarged upper end of the vibrator thereon and loosely sheaths the upper part of vibrator shank 123. Pipe 124 may be of polyvinylchloride (PVC). A lock nut 138 on the handle end of hand screw 133 may be tightened to sandwich leg 131 between it and stem 136 so as to lock pipe section 135 and thus vibrator shank 123 against rolling motion (i.e. pivoting from side to side about the axis of hand screw 133). Loosening of lock nut 138 thus permits such rolling adjustment. Thus, by reason of the several adjustments provided by bracket 126, the lower ends of vibrator shanks 123 may be positioned virtually anywhere within the hopper 18 to encourage, as needed, filling of the concrete chamber 55 of the slip-form from the hopper. It is also contemplated that further vibrator units 141 and 142 (e.g. pneumatic units) may be fixed as by angle brackets, to the front plate 59 (FIG. 1) of the slip-form to further assist elimination of voids or bubbles from concrete entering the slip-form passage 55. If desired, operator controls, not shown, for the vibrators may be provided at a convenient location on platform 101, the rear wall of hopper 18 or on winch support pipe 109.

Figure 6:
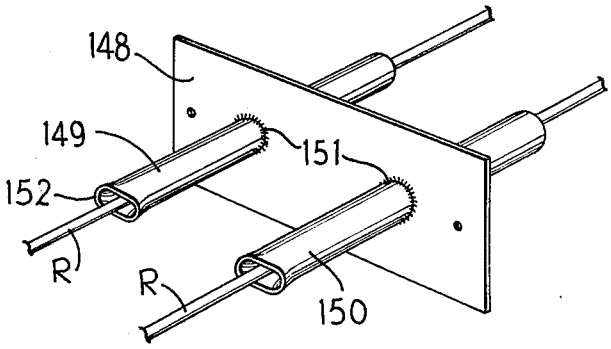
FIG. 6 is a pictorial view of a reinforcing rod guide locatable at the lower front portion of the hopper of the machine of FIG. 1.

Where, as may be the case, it is desired to encase longitudinally extending reinforcing rods in the concrete ribbon, a front plate 14 (FIG. 4) is removed from the lower central portion of front hopper wall 19, by release of screws 145, to reveal a downward opening notch 147 in the front hopper wall. An alternate front plate 148 is similar to plate 144 except for having at least one (here two) reinforcing rod guide pipes 149 and 150 extending side-by-side therethrough, as seen in FIG. 6. The pipes 149 and 150 extend perpendicular to plate 148, through suitable holes therein, and are preferably affixed thereto as by welding at 51. To facilitate insertion of conventional reinforcing rods R into tubes 149, the front ends 152 thereof are preferably widened substantially to a funnel shape. Lateral widening of pipe mouths 152 also facilitates passage of reinforcing rods R thereinto when forming a curved curb-gutter ribbon. Preferably, the greater length (such as ⅔ the length) of pipes 149 and 150 are to the rear of plate 148. Thus, by interchanging plates 144 and 148 on the front of the hopper, the machine is alternatively adaptable to formation of a concrete ribbon without or with longitudinal steel rod reinforcing therein.

OPERATION

The operation of the apparatus will be apparent from the above description but may be briefly summarized for convenience.

With the site leveled, or otherwise prepared, tracks 41 are staked on the ground substantially at the same centerline spacing as the wheels 27. The machine is placed on the tracks and cable 107 is run out to a stake 117 spaced ahead of the machine. Supply of concrete to the hopper 18 is initiated and operator OP standing on platform 101 cranks the winch 104 to advance the machine along the track at a desired, readily varied speed to advance the concrete curb-gutter ribbon. Operator OP has a direct and unimpeded view of the entire machine operation, and can readily adjust positioning of, for example, trowel member 77 and vibrators 121, if desired while still on the platform 101.

Although a particular preferred embodiment of the invention has been disclosed in detail for illustrative purposes, it will be recognized that variations or modification of the disclosed apparatus, including the rearrangement of parts, lie within the scope of the present invention.

The embodiments of the invention in which an exclusive property or privilege is claimed are defined as follows:

1. A machine for slip-forming a concrete curb-gutter, or the like, such machine including a hopper for receiving concrete, a downwardly opening slip-form fixed to and communicating in concrete receiving relation with the lower rear portion of the hopper to form a concrete ribbon of desired cross section, and means for guiding advancement of said machine along a predetermined path on which said concrete ribbon is to be formed, said machine further comprising:

a frame supporting said hopper and slip-form, said guiding means being mounted on said frame to support said frame for advancement along the proposed path of concrete ribbon;

an operator support platform means on said frame above said slip-form for directing the weight of a human operator on said platform means downwardly onto said slip-form;

winch means fixedly spaced above the hopper adjacent the front of said platform for actuation by a human operator standing on said platform, said winch means having a line anchorable ahead of said machine for winching said machine forwardly along said path;

a pipe member fixed with respect to said hopper and having an upper end fixedly supporting said winch means above said hopper, said pipe member extending downward into and forwardly along said hopper to emerge at the front wall of said hopper, the line of said winch extending downward and forward through said pipe member, and means engaging said winch line adjacent the front wall of said hopper for leading said winch line forwardly from said machine, whereby with the front end of said line anchored, actuation of said winch to draw in such line forwardly advances said machine.

2. The machine of claim 1, in which said winch means is a hand cranked winch.

3. A machine for slip-forming a concrete curb-gutter, or the like, such machine including a hopper for receiving concrete, a downwardly opening slip-form fixed to and communicating in concrete receiving relation with the lower rear portion of the hopper to form a concrete ribbon of desired cross section, and means for guiding advancement of said machine along a predetermined path on which said concrete ribbon is to be formed, said machine further comprising:

a frame supporting said hopper and slip-form, said guiding means being mounted on said frame to support said frame for advancement along the proposed path of the concrete ribbon;

an operator support platform means on said frame above said slip-form for directing the weight of a human operator on said platform means downward onto said slip-form;

a vibrator support bracket transversely overhanging the open upper end of said hopper and adjustably secured on a wall of said hopper for linear adjustment therealong and pitch adjustment with respect thereto, and a vibrator support member supported over the open upper end of said hopper on said support bracket for adjustment in roll with respect thereto, said vibrator support member being adjustable for determining the height of the lower end of the vibrator in the hopper.

4. The machine of claim 3, in which the said vibrator support bracket is L-shaped, having a downward extending leg slotted to receive the side wall of said hopper and having a pair of vertically spaced set screws engageable with the hopper wall to permit said linear and pitch adjustments, said L-shaped bracket having an upper, substantially horizontal leg extending over said hopper, said vibrator support member comprising a collar for receiving a sheath for a vibrator therethrough, a hand screw extending through said horizontal bracket leg for threaded advancement radially into said collar to engage said sheath and thereby control vertical adjustment of the vibrator, and a lock nut on said hand screw on the opposite side of said horizontal bracket leg and tightenable to prevent roll pivotal motion of said collar about the axis of said hand screw.

5. A machine for slip-forming a concrete curb-gutter, or the like, such machine including a hopper for receiving concrete, a downwardly opening slip-form fixed to and communicating in concrete receiving relation with the lower rear portion of the hopper to form a concrete ribbon of desired cross section, and means for guiding advancement of said machine along a predetermined path on which said concrete ribbon is to be formed, said machine further comprising:

a frame supporting said hopper and slip-form, said guiding means being mounted on said frame to support said frame for advancement along the proposed path of the concrete ribbon;

an operator support platform means on said frame above said slip-form for directing the weight of a human operator on said platform means downward onto said slip-form;

said slip-form comprising a longitudinally extending metal sheet of cross-sectional configuration corresponding to the top and opposite sides of the concrete ribbon to be formed, and a front plate fixed to and extending substantially vertically up from the top wall of said sheet, said form front plate being releasably fixed to a rear wall of said hopper, and including vibrator means fixed to and extending rearward from said front plate and actuable for assisting flow of concrete downward through said hopper and rearward into said form.

6. The machine of claim 5, in which said hopper has a front wall extending substantially to the ground to block forward escape of concrete therefrom, an opening through said front wall at least in part lying directly ahead of said form, and at least one adapter panel releasably fixed to said front wall for covering said opening and having open ended pipe means extending therethrough and sized for guiding of a reinforcing rod of selected cross-section into the mass of concrete deposited by said hopper and shaped by said form, to facilitate production of steel rod reinforced curbing or the like, said opening substantially exceeding the cross sectional area of a given said pipe means for alternate reception loosely therethrough of a variety of pipe means arrangements of one or several pipes each.

7. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downward substantially to the ground laterally inboard of said wheels;

fixed, ground supported tracks spaced laterally outboard of said sidewalls of said slip-form for supporting and guiding said wheels along the desired path of said concrete ribbon, said tracks including curvable portions for slip-forming a section of concrete ribbon along a curved path;

wheel mounting means including an axle having an inboard end portion pivoted on a respective vertical axis immediately adjacent the plane of the opposed slip-form sidewall, said axle extending outboard away from said slip-form with said wheel mounted on the outboard end of said axle remote from said slip-form, said axle permitting said wheel to roll forward and rearward with respect to said slip-form, along the outer circumferential edge of a horizontal arc, said wheels being spaced laterally outboard of their respective vertical pivot axes at a distance sufficient to permit said pivoting of said wheels without interference with said slip-form, and releasable locking means for releasably fixing each said axle with its wheel at a desired point along said horizontal arc circumference for permitting advancement of said machine along a curved track portion.

8. The machine of claim 7, including side rails supporting said hopper and slip-form on said wheels, and in which said wheel mounting means includes a block fixed to and extending laterally outwardly from said side rail, said axle being rotatably engaged by said wheel and extending beneath said block and side rail, a vertical pivot member defining said vertical pivot axis and pivotally securing the inner end of said axle to said side rail, said releasable locking means releasably securing an intermediate portion of said axle to said block to fix the horizontal angle of said axle with respect to said side rail at a desired angle in a range corresponding to both rightward and leftward turning of said machine.

9. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downwardly substantially to the ground laterally inboard of said wheels;

fixed, ground supported tracks spaced laterally outboard of said sidewalls of said slip-form for supporting and guiding said wheels along the desired path of said concrete ribbon;

side rails extending along opposite sides of said slip-form and hopper and supporting same in mutually fixed relation, said wheels being rotatably mounted on said side rails;

said slip-form comprising a top wall from which depend said opposite side walls, elongate mounting members fixed to the outer faces of said side walls and sloped upward toward the rear with respect to the walls of said slip-form, said mounting members being releasably securable to said side rails to support said slip-form releasably thereon with the rear end of said slip-form depressed below its front end with respect to said side rails, said slip-form further including an upstanding front plate rising up from said slip-form top wall and adapted to face abut the rear wall of said hopper, and including means releasably securing said front plate to said hopper rear wall to complete releasable securement to said slip-form in said machine while permitting interchanging of slip-forms of different cross-sectional shape to permit the same machine to produce curb and gutter, curb, gutter or the like concrete ribbons of different cross section, the rear wall of said hopper having a bottom edge overlapped by said front plate and lying above said slip-form top wall but below said means securing said front plate to said hopper rear wall.

10. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downward substantially to the ground laterally inboard of said wheels;

fixed, ground supported tracks spaced laterally outboard of said sidewalls of said slip-form for supporting and guiding said wheels along the desired path of said concrete ribbon;

a trowel member disposed at a substantially fixed spacing from the rear edge of said slip-form, said trowel member and slip-form being of substantially rigid sheet material and of inverted, substantially U-shaped cross section, said trowel member following the cross-section of said slip-form and having opposite side walls extending downward substantially to the ground, and support means incorporating, adjacent each side of the trowel, a pair of vertical spaced and substantially horizontally extending top and bottom pivot links supporting said trowel member for vertical adjustment at a substantially constant rearward spacing from said slip-form while substantially maintaining the relative inclination of the top walls of said slip-form and trowel member, said support means further including a pair of supports on the top wall of said slip-form adjacent the opposite sides thereof, each said support comprising an upstanding post fixed on said slip-form top wall, said top pivot links each being substantially L-shaped having a substantially horizontal first leg with its free end pivoted adjacent the lower end of said post, said L-shaped link having its legs joined at a common point spaced rearwardly from said slip-form and pivotally secured atop said trowel member, said L-shaped link having a second leg upstanding from said trowel member in spaced relation behind said post and including an axial adjustor extending from the upper end of said L-member leg downward at a slope to a pivot point on said post, wherein axial adjustment of said adjustor raises and lowers said trowel, said bottom pivot links each pivotally connecting adjacent sides of said slip-form and trowel member, the opposed edges of the walls of said trowel member and slip-form being spaced by a bubble release gap.

11. The machine of claim 10, including a substantially rigid hold-down strap extending rearward from the middle portion of the top wall of said slip-form over the mid portion of the top wall of said trowel member and having a substantially vertical adjustment screw threaded therethrough to bear against said trowel member to prevent upward buckling of said trowel member as it is forced downward against concrete emerging from the rear of said slip-form.

12. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downward substantially to the ground laterally inboard of said wheels;

fixed, ground supported tracks spaced laterally outboard of said sidewalls of said slip-form for supporting and guiding said wheels along the desired path of said concrete ribbon;

a frame comprising a pair of side rails extending horizontally with said hopper and slip-form supported therebetween, said hopper having side walls and spacers interposed between and fixedly interconnecting the side walls of said slip-form and hopper to the opposed faces of said side rails, an upstanding batten overlapping the joint between the side walls of said slip-form and hopper and fixed to one of said slip-form and hopper for preventing leakage of concrete therebetween, said spacers and battens being fixed with respect to each other to permit rearward sliding of the slip-form from between said side rails, and including a trowel member fixed to the rear of and corresponding in cross section to said slip-form, with further battens overlapping the sides of said slip-form and trowel member to prevent leakage of concrete therepast.

13. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downward substantially to the ground laterally inboard of said wheels;

fixed, ground supported tracks spaced laterally outboard of said side walls of said slip-form for supporting and guiding said wheels along the desired path of said concrete ribbon;

an antivibration web of rigid platelike material fixed to and extending upward from the top wall of said slip-form near the rear end thereof.

14. A self-supporting machine for slip-forming a concrete ribbon along a preselected path, including a hopper for receiving concrete and a slip-form extending from and communicating with the lower rear portion of said hopper for forming said concrete to the desired cross-sectional shape as the machine advances along said path, said machine further comprising:

wheels fixed at opposite sides of said slip-form to support said slip-form therebetween, said slip-form having opposite side walls extending downward substantially to the ground laterally inboard of said wheels; and fixed, ground supported tracks spaced laterally outboard of said side walls of said slip-form for supporting and guiding said wheels along the desired path of said concrete ribbon, said tracks comprising wheel supporting means and wheel guiding means, said wheel supporting means being conventional construction timbers laid on their sides on the ground in substantially parallel relation on opposite sides of the path of the proposed concrete ribbon, and including stakes insertable through holes in said timbers for staking same to the ground, said wheel guiding means being a conventional elongated metal reinforcing rod substantially centered on and fixed longitudinally to the top of the timber on one side of said path, the wheels atop the latter timber having circumferential grooves receiving said reinforcing rod and laterally guiding said slipform along said tracks, while the wheels on the other side of the machine are free to wander laterally atop the other timber.

15. The machine of claim 14, in which said tracks curve for forming a concrete ribbon along a curved path, said reinforcing rod being bent to a curved configuration defining the curvature of said path, said timbers for the curved portion of each track comprising short straight segments laid end to end through the curve and staked to the ground, adjacent timber segments for the curved portion of one track being connected by said bent reinforcing rod, said wheels being pivotable in a horizontal plane to follow the curvature of said rod.

* * * * *